US006588313B2

(12) United States Patent
Brown et al.

(10) Patent No.: US 6,588,313 B2
(45) Date of Patent: Jul. 8, 2003

(54) HYDRAULIC PISTON POSITION SENSOR

(75) Inventors: Gregory C. Brown, Chanhassen, MN (US); Brian E. Richter, Bloomington, MN (US)

(73) Assignee: Rosemont Inc., Eden Prairie, MN (US)

( * ) Notice: Subject to any disclaimer, the term of this patent is extended or adjusted under 35 U.S.C. 154(b) by 0 days.

(21) Appl. No.: 09/991,817

(22) Filed: Nov. 19, 2001

(65) Prior Publication Data

US 2002/0170424 A1 Nov. 21, 2002

Related U.S. Application Data

(60) Provisional application No. 60/291,306, filed on May 16, 2001.

(51) Int. Cl.[7] ..... F01B 25/26
(52) U.S. Cl. ..... 92/5 R; 324/642; 91/1
(58) Field of Search ..... 92/5 R; 91/1, 361; 324/642

(56) References Cited

U.S. PATENT DOCUMENTS

| | | | | |
|---|---|---|---|---|
| 1,480,661 | A | 1/1924 | Brown | |
| 1,698,314 | A | 1/1929 | Mapelsden | |
| 2,943,640 | A | 7/1960 | James | 137/594 |
| 3,160,836 | A | 12/1964 | Farley | 336/30 |
| 3,388,597 | A | 6/1968 | Bargen et al. | 73/398 |
| 3,430,489 | A | 3/1969 | Pfrehm | 73/231 |
| 3,494,190 | A | 2/1970 | Schwartzman | 73/228 |
| 3,561,831 | A | 2/1971 | Alibert et al. | 310/8.7 |
| 3,657,925 | A | 4/1972 | Gross | 73/239 |
| 3,678,754 | A | 7/1972 | Amir et al. | 73/419 |
| 3,817,283 | A | 6/1974 | Hewson | |
| 3,958,492 | A | 5/1976 | Curless | 91/363 R |
| 4,031,813 | A | 6/1977 | Walters et al. | 91/433 |
| 4,100,798 | A | 7/1978 | Nilsson et al. | 73/194 E |
| 4,126,047 | A | 11/1978 | Sethares et al. | 73/505 |
| 4,193,420 | A | 3/1980 | Hewson | 137/356 |

(List continued on next page.)

FOREIGN PATENT DOCUMENTS

| | | |
|---|---|---|
| DE | 3116333 A1 | 4/1981 |
| DE | 3244668 | 6/1984 |
| DE | 4220333 | 12/1993 |
| DE | 94 17 204.8 | 10/1994 |
| DE | 686 831 A2 | 12/1995 |
| DE | 29616034 | 2/1997 |
| EP | 0154531 | 9/1985 |
| EP | 0266606 A2 | 10/1987 |
| EP | 0309643 | 4/1989 |

(List continued on next page.)

OTHER PUBLICATIONS

"A Physicist's Desk Reference", *American Institute of Physics*, New York, 1992, p. 201.
"Handbook of Chemistry and Physics", CRC Press, Ohio, 1975, p. E–223.
"The Electrical Engineering Handbook", Editor–in–Chief, R. Dorf, CRC Press, 1997, pp. 811–812.
Brochure: Technik, "Absolute Position Measurement Using Conducive Plastic Potentiometers".
Brochure: Penny + Giles "Technology Leaders in Displacement Monitoring & Manual Control".

(List continued on next page.)

*Primary Examiner*—Edward K. Look
*Assistant Examiner*—Thomas E. Lazo
(74) *Attorney, Agent, or Firm*—Westman, Champlin & Kelly, P.A.

(57) ABSTRACT

A piston position in a cylinder of a hydraulic assembly is measured using microwave pulses. The microwave pulses are launched along a conductor coupled to the piston or cylinder. A sliding member is slidably coupled to the conductor and moves with the piston or cylinder. Position is determined as a function of a reflection from the end of the conductor and the sliding member.

20 Claims, 6 Drawing Sheets

U.S. PATENT DOCUMENTS

| | | | | |
|---|---|---|---|---|
| 4,205,592 | A | 6/1980 | Haüssler | 91/449 |
| 4,249,164 | A | 2/1981 | Tivy | 340/870.3 |
| 4,275,793 | A | 6/1981 | Schivley, Jr. et al. | 173/9 |
| 4,304,136 | A | 12/1981 | McCabe et al. | 73/861.54 |
| 4,319,492 | A | 3/1982 | Hewson et al. | 73/756 |
| 4,381,699 | A | 5/1983 | Haussler | 91/433 |
| 4,424,716 | A | 1/1984 | Boehringer et al. | 73/861.56 |
| 4,436,348 | A | 3/1984 | Farr | 303/115 |
| 4,466,290 | A | 8/1984 | Frick | 73/756 |
| 4,520,660 | A | 6/1985 | Hitchcock | 73/120 |
| 4,539,967 | A | 9/1985 | Nakajima et al. | 123/585 |
| 4,543,649 | A | 9/1985 | Head et al. | 367/96 |
| 4,545,406 | A | 10/1985 | King | 137/553 |
| 4,557,296 | A | 12/1985 | Byrne | 138/44 |
| 4,584,472 | A | 4/1986 | Wiblin et al. | 250/237 G |
| 4,588,953 | A | 5/1986 | Krage | 324/58.5 C |
| 4,631,478 | A | 12/1986 | Knetsch et al. | 324/207 |
| 4,671,166 | A | 6/1987 | Glaze et al. | 91/361 |
| 4,689,553 | A | 8/1987 | Haddox | 324/58.5 C |
| 4,737,705 | A | 4/1988 | Bitar et al. | 324/58.5 C |
| 4,742,794 | A | 5/1988 | Hagstrom | 114/286 |
| 4,744,218 | A | 5/1988 | Edwards et al. | 60/368 |
| 4,745,810 | A | 5/1988 | Pierce et al. | 73/706 |
| 4,749,936 | A | 6/1988 | Taplin | 324/58.5 B |
| 4,751,501 | A | 6/1988 | Gut | 340/607 |
| 4,757,745 | A | 7/1988 | Taplin | 91/361 |
| 4,774,465 | A | 9/1988 | Nilius | 324/208 |
| 4,841,776 | A | 6/1989 | Kawachi et al. | 73/706 |
| 4,866,269 | A | 9/1989 | Wlodarczyk et al. | 250/231 |
| 4,901,628 | A | 2/1990 | Krage | 92/5 R |
| 4,932,269 | A | 6/1990 | Cammarata, III et al. | 73/861.61 |
| 4,938,054 | A | 7/1990 | Dye et al. | 73/3 |
| 4,961,055 | A | 10/1990 | Habib et al. | 324/662 |
| 4,987,823 | A | 1/1991 | Taplin et al. | 91/361 |
| 5,000,650 | A | 3/1991 | Brewer et al. | 414/699 |
| 5,031,506 | A | 7/1991 | Baisch et al. | 91/363 R |
| 5,036,711 | A | 8/1991 | Good | 73/861.66 |
| 5,072,198 | A | 12/1991 | Taplin et al. | 333/33 |
| 5,085,250 | A | 2/1992 | Kendrick | 138/44 |
| 5,104,144 | A | 4/1992 | Bethell | 280/707 |
| 5,150,049 | A | 9/1992 | Schuetz | 324/207.12 |
| 5,150,060 | A | 9/1992 | Bitar | 324/635 |
| 5,182,979 | A | 2/1993 | Morgan | 92/5 R |
| 5,182,980 | A | 2/1993 | Greer | 92/5 R |
| 5,218,820 | A | 6/1993 | Sepehri et al. | 60/463 |
| 5,218,895 | A | 6/1993 | Lukich et al. | 91/361 |
| 5,233,293 | A | 8/1993 | Huang et al. | 324/207.15 |
| 5,241,278 | A | 8/1993 | Bitar | 324/635 |
| 5,247,172 | A | 9/1993 | Riemer | 250/227.21 |
| 5,260,665 | A | 11/1993 | Goldberg et al. | 324/636 |
| 5,274,271 | A | 12/1993 | McEwan | 307/108 |
| 5,313,871 | A | 5/1994 | Kaneko et al. | 91/361 |
| 5,325,063 | A | 6/1994 | Morgan | 324/636 |
| 5,332,938 | A | 7/1994 | McEwan | 307/572 |
| 5,345,471 | A | 9/1994 | McEwan | 375/1 |
| 5,361,070 | A | 11/1994 | McEwan | 342/21 |
| 5,365,795 | A | 11/1994 | Brower, Jr. | 73/861.65 |
| 5,422,607 | A | 6/1995 | McEwan | 333/20 |
| 5,424,941 | A | 6/1995 | Bolt et al. | 364/148 |
| 5,438,261 | A | 8/1995 | Codina et al. | 324/207.16 |
| 5,438,274 | A | 8/1995 | Bitar et al. | 324/636 |
| 5,455,769 | A | 10/1995 | Panoushek et al. | 364/424.07 |
| 5,457,394 | A | 10/1995 | McEwan | 324/642 |
| 5,457,960 | A | 10/1995 | Morishita | 91/361 |
| 5,461,368 | A | 10/1995 | Comer | 340/607 |
| 5,465,094 | A | 11/1995 | McEwan | 342/28 |
| 5,469,749 | A | 11/1995 | Shimada et al. | 73/861.47 |
| 5,471,147 | A | 11/1995 | Allen et al. | 324/635 |
| 5,471,162 | A | 11/1995 | McEwan | 327/92 |
| 5,479,120 | A | 12/1995 | McEwan | 327/91 |
| 5,491,422 | A | 2/1996 | Bitar et al. | 324/636 |
| 5,510,800 | A | 4/1996 | McEwan | 342/387 |
| 5,512,834 | A | 4/1996 | McEwan | 324/642 |
| 5,517,198 | A | 5/1996 | McEwan | 342/89 |
| 5,519,342 | A | 5/1996 | McEwan | 327/94 |
| 5,519,400 | A | 5/1996 | McEwan | 342/28 |
| 5,521,600 | A | 5/1996 | McEwan | 342/27 |
| 5,523,760 | A | 6/1996 | McEwan | 342/89 |
| 5,535,587 | A | 7/1996 | Tanaka et al. | 60/427 |
| 5,536,536 | A | 7/1996 | Kelley | 427/386 |
| 5,540,137 | A | 7/1996 | Lark et al. | 92/5 R |
| 5,563,605 | A | 10/1996 | McEwan | 342/202 |
| 5,573,012 | A | 11/1996 | McEwan | 128/782 |
| 5,576,498 | A | 11/1996 | Shambayati | 73/861.52 |
| 5,576,627 | A | 11/1996 | McEwan | 324/639 |
| 5,581,256 | A | 12/1996 | McEwan | 342/37 |
| 5,587,536 | A | 12/1996 | Rasmussen | 73/744 |
| 5,589,838 | A | 12/1996 | McEwan | 342/387 |
| 5,602,372 | A | 2/1997 | Strelow | 200/81.9 R |
| 5,609,059 | A | 3/1997 | McEwan | 73/290 R |
| 5,617,034 | A | 4/1997 | Lark et al. | 324/635 |
| 5,661,277 | A | 8/1997 | Graham, II | 200/81.9 R |
| 5,710,514 | A | 1/1998 | Crayton et al. | 324/635 |
| 5,773,726 | A | 6/1998 | Mahoney et al. | 73/861.65 |
| 5,817,950 | A | 10/1998 | Wiklund et al. | 73/861.66 |
| 5,861,546 | A | 1/1999 | Sagi et al. | 73/40.5 |
| 5,901,633 | A | 5/1999 | Chan et al. | 92/5 R |
| 5,977,778 | A * | 11/1999 | Chan et al. | 92/5 R |
| 6,142,059 | A | 11/2000 | Chan et al. | 92/5 R |
| 6,269,641 | B1 | 8/2001 | Dean | 60/567 |
| 6,484,620 | B2 * | 11/2002 | Arshad et al. | 92/5 R |

FOREIGN PATENT DOCUMENTS

| | | |
|---|---|---|
| EP | 0331772 | 9/1989 |
| EP | 0 887 626 A1 | 6/1998 |
| EP | 0941409 | 9/1999 |
| FR | 2485724 | 12/1981 |
| GB | 1080852 | 8/1967 |
| GB | 1467957 | 3/1977 |
| GB | 2155635 | 9/1985 |
| GB | 2172995 A | 10/1986 |
| GB | 2259147 | 3/1993 |
| GB | 2 301 676 | 12/1996 |
| JP | 0168106 | 10/1982 |
| JP | 57-198823 | 12/1982 |
| JP | 6160605 | 7/1986 |
| JP | 63070121 | 3/1988 |
| JP | 01207634 | 11/1989 |
| JP | 04-225126 | 8/1992 |
| JP | 01168107 | 10/1992 |
| JP | 06-213694 | 1/1994 |
| WO | WO 96/24028 | 8/1996 |
| WO | WO 98/23867 | 6/1998 |

OTHER PUBLICATIONS

Brochure: DC Hydrostar, "Position Transducer".

"An LVDT Primer", *Sensors*, Jun. 1996, pp. 27–30.

"Understanding Magnetostrictive LDTs", W.D. Peterson, *Hydraulics & Pneumatics*, Feb. 1993, pp. 32–34.

Brochure: Penny + Giles Product Data, "Cylinder Transducer Model HLP100".

Magazine: "Not Just a Blip on the Screen", *Business Week*, Feb. 19, 1996, pp. 64–65.

U.S. patent application Ser. No. 09/394,728, Kleven, filed Sep. 13, 1999.

U.S. patent application Ser. No. 09/395,688, Kleven, filed Sep. 13, 1999.

U.S. patent application Ser. No. 09/521,132, Wiklund et al., filed Mar. 8, 2000.
U.S. patent application Ser. No. 09/521,537, Wiklund et al., filed Mar. 8, 2000.
U.S. patent application Ser. No. 60/218,329, Krouth, filed Jul. 14, 2000.
U.S. patent application Ser. No. 60/187,849, Schumacher, filed Mar. 8, 2000.
Process Instrument Engineers Handbook, Revised Edition, Chapters 2.10, 2.11, and 2.12, pp. 87–110 (1982).
Model 8800A Vortex Flowmeter, Key Differentiators (undated).
Model 1195 Integral Orifice Assembly, Rosemount Catalog pp. Flow–125 –Flow 137 (Published 1995).
Model 8800 Smart Vortex Flowmeter, Fisher–Rosemount, Managing the Process Better, pp. 2–19, (1994).
Model 8800A Smart Vortex Flowmeter, Fisher–Rosemount, Managing the Process Better, pp. 2–21 (1997).
On–Line Catalog Level and Flow Instrumentation—Flow Gauges, Industrial Process Measurement, Inc., re: RCM Industries, Inc. products, 6 pages.
Kobold, re: RCM Industries, Inc. products, pp. 13–18.
Nishimoto T. et al., article entitled "Buried Piezoresistive sensors by means of MeV ion implantation", *Sensors and Actuators*, May 1994, vol. A43, No. 1/3. pp. 249–253.

* cited by examiner

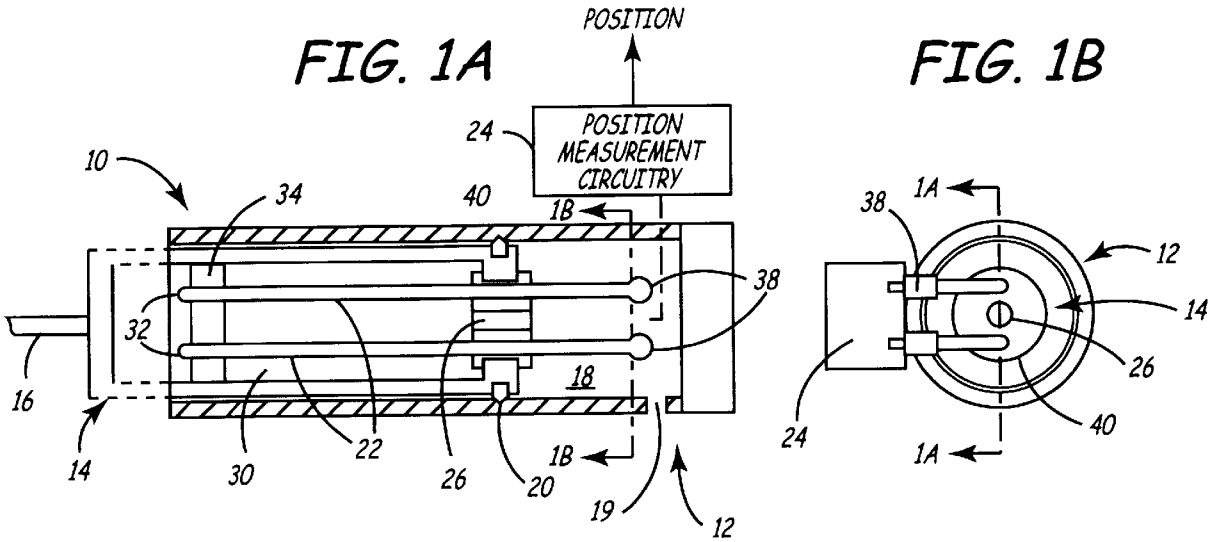
FIG. 1A
FIG. 1B
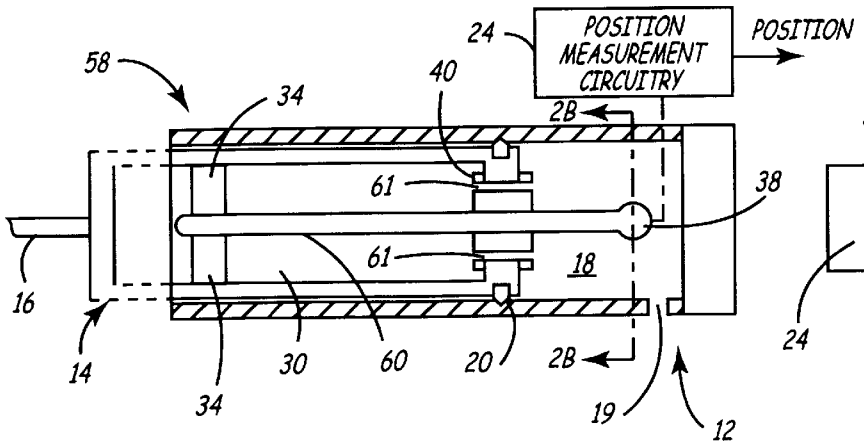
FIG. 2A
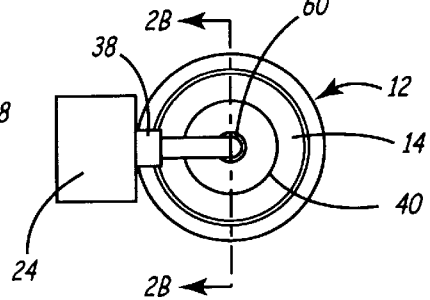
FIG. 2B

HYDRAULIC PISTON POSITION SENSOR

The present application is based on and claims the benefit of U.S. provisional patent application Ser. No. 60/291,306, filed May 16, 2001, the content of which is hereby incorporated by reference in its entirety.

BACKGROUND OF THE INVENTION

The present invention relates to hydraulic pistons. More specifically, the present invention relates to position sensors used to sense the relative position between a piston and a hydraulic cylinder.

Various types of displacement sensors are used to measure the relative position of a piston in a hydraulic cylinder. However, devices to remotely measure absolute displacement in harsh environments with a high degree of reliability are presently complex and costly. Examples of presently used technologies are Magnitostrictive devices that use time of flight of a mechanical signal along a pair of fine wires encased in a sealed metal tube, which is reflected back from a magnitostrictively induced change in the rod's mechanical properties. Another technology uses an absolute rotary encoder, which is a device that senses rotation. The translational to rotary conversion is typically done with gears, or a cable or tape that is uncoiled from a spring loaded drum. Absolute encoders tend to suffer from limited range and/or resolution. Harsh environments that include high levels of vibration tend to exclude absolute etched glass scales from consideration due to their critical alignment requirements, their susceptibility to brittle fracture and intolerance to fogging and dirt. This technology also needs to be re-zeroed frequently.

Inferred displacement measurements such as calculating the translation of a cylinder by integrating a volumetric flow rate into the cylinder over time suffer from several difficulties. First, these devices are incremental and require frequent, manual re-zeroing. Secondly, they tend to be sensitive to environmental effects, such as temperature and density. They require measuring these variables to provide an accurate displacement measurement. Further, integrating flow to determine displacement tends to decrease the accuracy of measurement. This technology also is limited by the dynamic sensing range of the flow measurement. Flows above and below this range are susceptible to very high errors.

One technique used to measure piston position uses electromagnetic bursts and is described in U.S. Pat. Nos. 5,977,778, 6,142,059 and WO 98/23867. However, this technique is prone to emitting radiation into the environment and is difficult to calibrate.

SUMMARY OF THE INVENTION

An apparatus to measure relative position of a hydraulic piston in a cylinder, includes a rod extending along the direction of movement of the piston and the rod which is fixedly coupled to one of the piston or cylinder. The rod is configured to carry a microwave pulse. A sliding member is slidably coupled to the rod and fixedly coupled to the other of one of the piston or cylinder. The sliding member is configured to cause a partial reflection of the microwave pulse. The end of the distal rod also provides a reflection. Piston position is calculated as a function of reflected microwave pulses from the sliding member and the rod end.

BRIEF DESCRIPTION OF THE DRAWINGS

FIG. 1A is a side cross-sectional view of a hydraulic assembly including position measurement circuitry.

FIG. 1B is a top cross-sectional view taken along the line labeled 1B—1B in FIG. 1A.

FIG. 2A is a side cross-sectional view of a hydraulic assembly including position measurement circuitry.

FIG. 2B is a top cross-sectional view taken along the line labeled 2B—2B in FIG. 2A.

DETAILED DESCRIPTION OF THE PREFERRED EMBODIMENTS

Figure 2C:
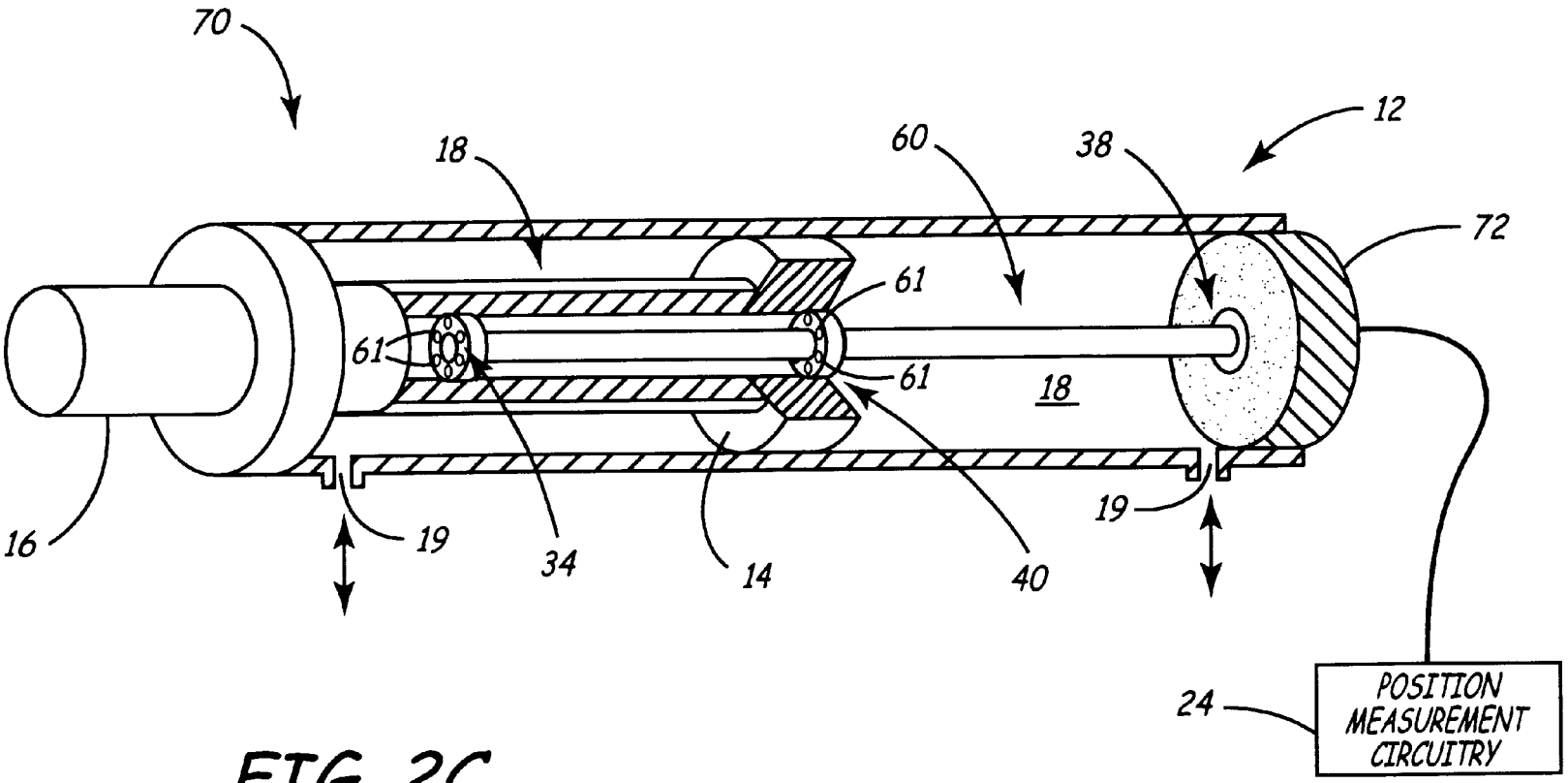
FIG. 2C is a partial cutaway perspective view of another embodiment of a hydraulic assembly.

FIG. 1A is a side cross-sectional view and FIG. 1B is a top cross-sectional view of a hydraulic piston/cylinder assembly 10 in accordance with one embodiment of the invention. Assembly 10 includes cylinder 12 which slidably carries piston 14 therein which is coupled to piston rod 16. Piston 14 moves within cylinder 12 in response to hydraulic fluid 18 being applied to or withdrawn from the interior of cylinder 12 through an orifice 19. A seal 20 extends around piston 14 to prevent leakage of hydraulic fluid therepast. Rods 22 extend along the length of cylinder 12 and are coupled to position measurement circuitry 24. Position measurement circuitry 24 couples to rods 22 through feedthrough connections 38. An orifice 26 is provided in piston 14 such that hydraulic fluid flows into cavity 30 within piston 14. The distal ends 32 of rods 22 can be held by a support 34.

In operation, piston 14 slides within cylinder 12 as hydraulic fluid 18 is injected into or removed from cylinder 12. Piston 14 also slides along rods 22 which are received in cavity 30 of piston 14. Contacting guide or bushing 40 rides along rods 22 as piston 14 moves within cylinder 12. Although the rods 22 are shown fixed to cylinder 12. They can also be fixed to piston 14 and move relative to cylinder 12.

Position measurement circuitry 24 provides a position output based upon reflections from microwave signals which are coupled to rods 22. The microwave signal is reflected at two locations on rods 22: at contacting guide or bushing 40 and at rod ends 32. Position measurement circuitry is responsive to the ratio of the time delay between the two reflected signals to determine the relative position of piston 14 in cylinder 12.

In a preferred embodiment, the present invention utilizes Micro Time Domain Reflectometry Radar (MTDR). MTDR technology is a time of flight measurement technology. A well-defined impulse or pulsed microwave radar signal is coupled into suitable medium. The radar signal is coupled into transmission lines made in the shape of dual parallel conductors. This dual parallel conductor geometry is preferable because it limits radiated electromagnetic interference (EMI). The device responsible for the generation of the radar signal, the coupling of the radar signal into the transmission line, and the sensing of the reflected signal is referred to herein as the transducer.

The basic MTDR measurement is achieved by sending a radar pulse down a long, slender transmission line such as rods 22 in FIG. 1 and measuring to a high degree of accuracy how long it takes the signal to travel down to a point of reflection and back again. This point of reflection can be from the distal end 32 of the transmission line, or from a second mechanical body such as support 34 contacting (or adjacent to) the transmission line along its length. If a mechanical body (sliding member 40) is made to move along the length of the transmission line, its position can be determined from the transit time of its reflected pulse. Specifically, a reference radar pulse that is sent to the end 32 of the transmission line formed by rods 22 is generated and timed. This is then compared to the pulse transit time reflected by the sliding mechanical body 40. One advantage of this technique is that the measurement is independent of the medium surrounding the transmission line.

A further advantage of this measurement technique is that the frequency of measurement occurs sufficiently rapidly to differentiate the position measurements in time to thereby obtain velocity and acceleration of the piston, if desired. In addition, by suitably arranging the geometry of the transmission lines, angular displacement can also be measured.

One embodiment of the invention includes the use of a dual element transmission line. This provides two functions. First, it contains radiation to thereby satisfy government regulation. Secondly, in various embodiments the second transmission line can be the cylinder housing itself. This is grounded with respect to the sensing rod, protecting it from spurious changes in dielectric external to the cylinder, such as a coating of mud or other external materials. In a preferred embodiment of the invention, a transient protection scheme is provided to prevent electronics failure in the event of an electrical surge being applied to the cylinder housing.

Another aspect of the invention includes the management of the impedance transitions along the wiring connections between the frequency generation circuitry and the sensing transmission line. Smooth transitions are preferred. Preferably, this is accomplished by gradually changing the spacing between ground and the conductor over a length $\geqq$¼ wavelength of the pulse. Impedance mismatches that are not gradual appear as ringing (additional pulses) back to the measurement circuit. One limitation of time measured displacement is that the first few inches are typically the most challenging to measure, because the reflected pulse must have a very high "Q" to be distinguishable from the original pulse. Poorly designed impedance mismatches produce a low "Q" reflected signal, resulting in difficulty measuring displacement near the zero position.

FIG. 2A is a side cross-sectional view and FIG. 2B is a top cross-sectional view of a hydraulic system 58 in accordance with another embodiment. In FIGS. 2A and 2B, elements similar to those illustrated in FIGS. 1A and 1B are numbered the same. In FIGS. 2A and 2B, a single rod 60 carries two separate conducting rods. This configuration reduces the number of openings which must be provided through piston 14. Openings 61 allow fluid flow past guide 14.

FIG. 2C is a partial cutaway perspective view of another embodiment of a hydraulic system 70 in accordance with another example embodiment. In FIG. 2C, guides 34 and 40 slide within piston rod 16 and have openings 61 formed therein. Feed through connection 38 extends from a base 72 cylinder 12.

Figure 3:
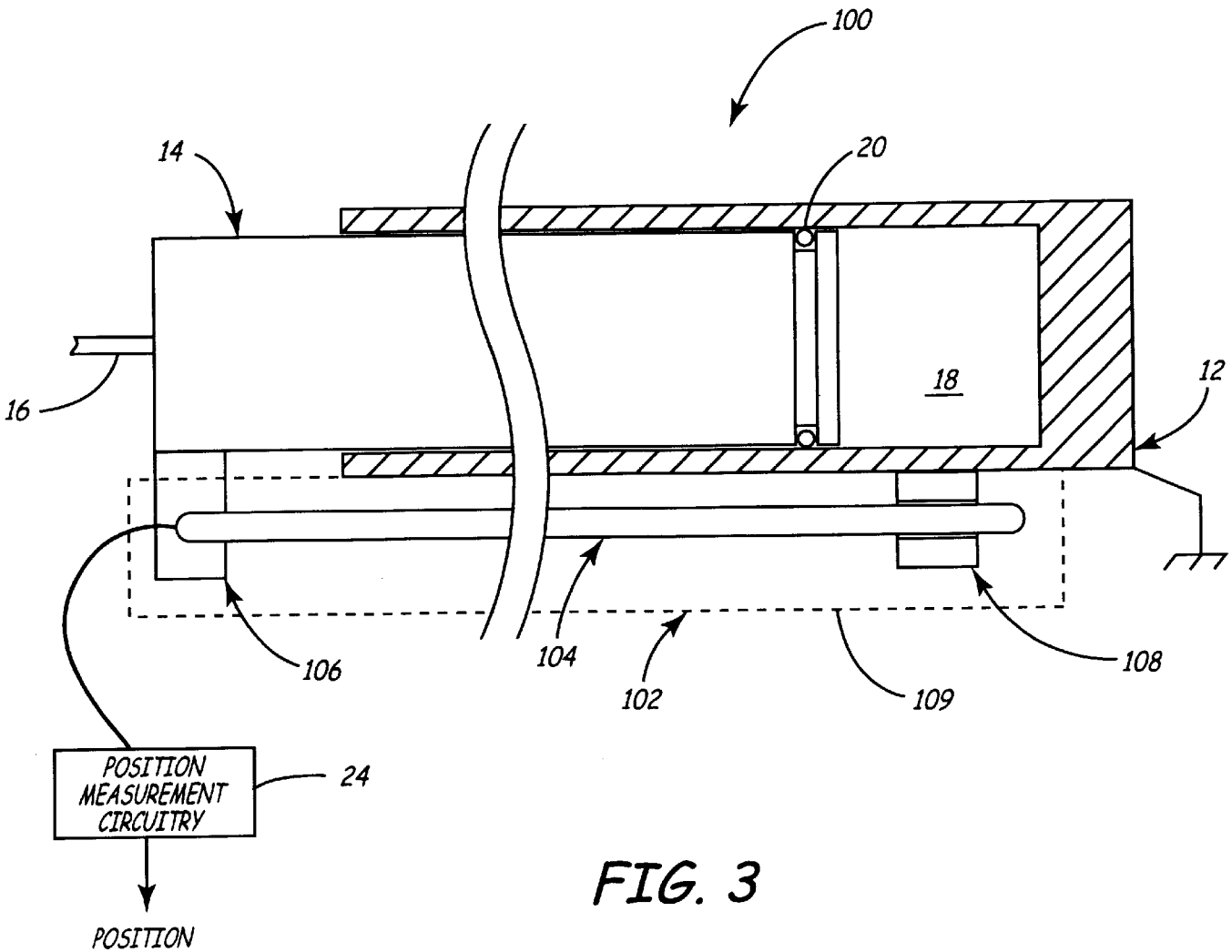
FIG. 3 is a side cross-sectional view of a hydraulic system in which a rod is positioned external to the cylinder.

FIG. 3 is a cross-sectional view of a hydraulic system 100 in accordance with another embodiment. In the embodiment of FIG. 3, a rod assembly 102 is positioned outside of the cylinder 12. Rod 104 is affixed to piston 14 at connection 106 and slides in contacting glide 108. This configuration is advantageous because the piston 14 and cylinder 12 do not require modification. A housing 109 can be of a metal to provide shielding and the entire assembly 100 can be coupled to a electrical ground to prevent spurious radiation from the microwave signal generated by position measurement circuitry 24.

Figure 4:
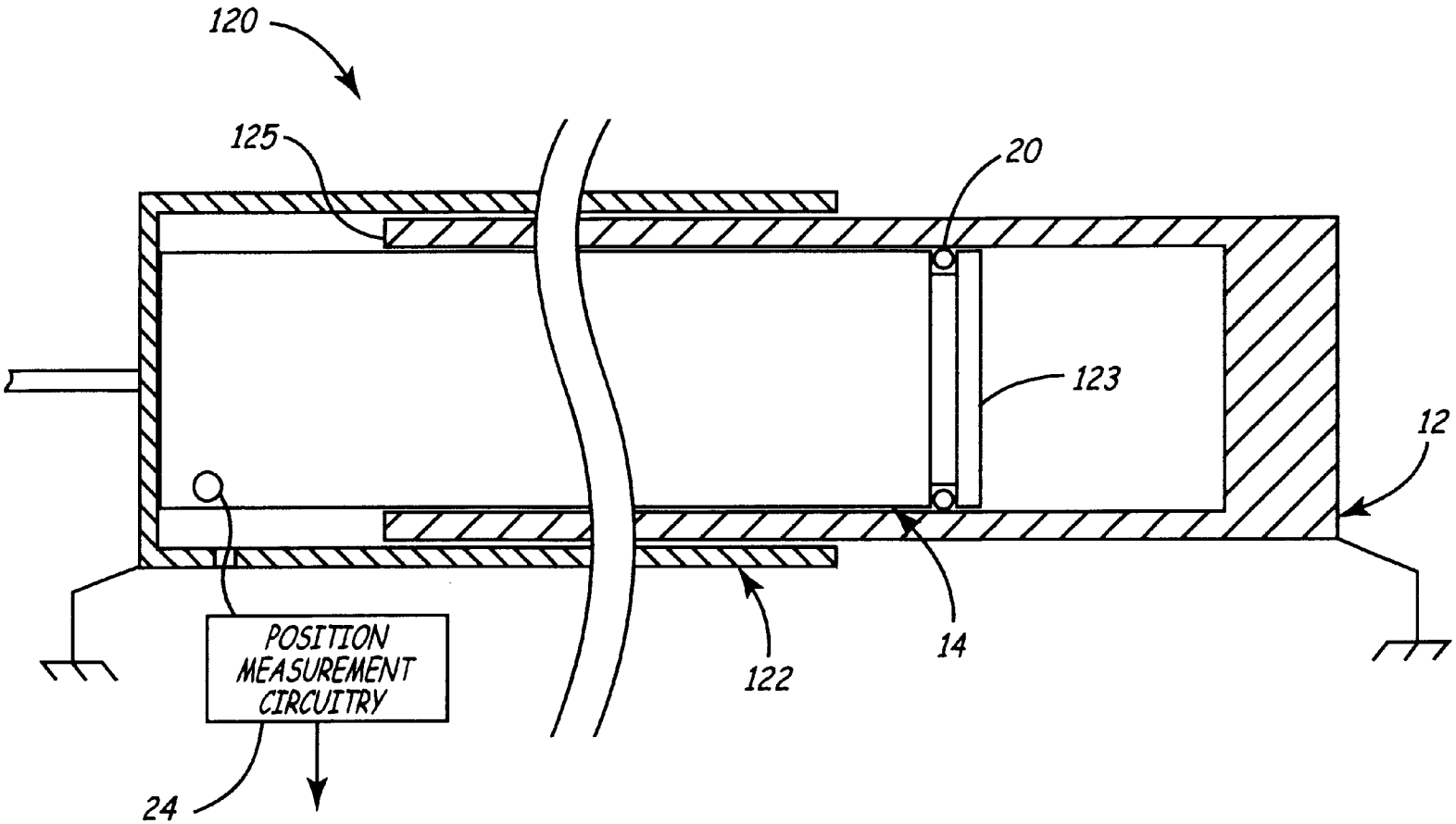
FIG. 4 is a side cross-sectional view of a hydraulic system in which the piston is used for position measurement.

FIG. 4 shows a hydraulic system 120 in accordance with another embodiment. Reflections are generated at the end 123 of piston 14 and end 125 of cylinder 12. Elements similar to FIGS. 1A and 1B are numbered the same. In FIG. 4, a conductive second antenna member 122 is provided which surrounds the cylinder 112 and is connected to electrical ground. In this embodiment, the cylinder or piston is coated with a non-conductive material. Second antenna member 122 can be a sheath or a metal rod depending upon the external environment, and preferably is a corrosion resistant material with a suitable dielectric. Alternatively, the material can be conductive. Second antenna member 122 is coupled to, and moves with, piston 14. Piston 14 is coupled to position measurement circuitry 24. In such an embodiment, a signal source can be coupled directly to the base metal of the cylinder and reflections from the end of the cylinder detected. The cylinder and piston can also be driven with the radar signal in an opposite configuration. An external second conductive sheath can surround the cylinder and/or piston to prevent the system from radiating into the environment.

Figure 5:
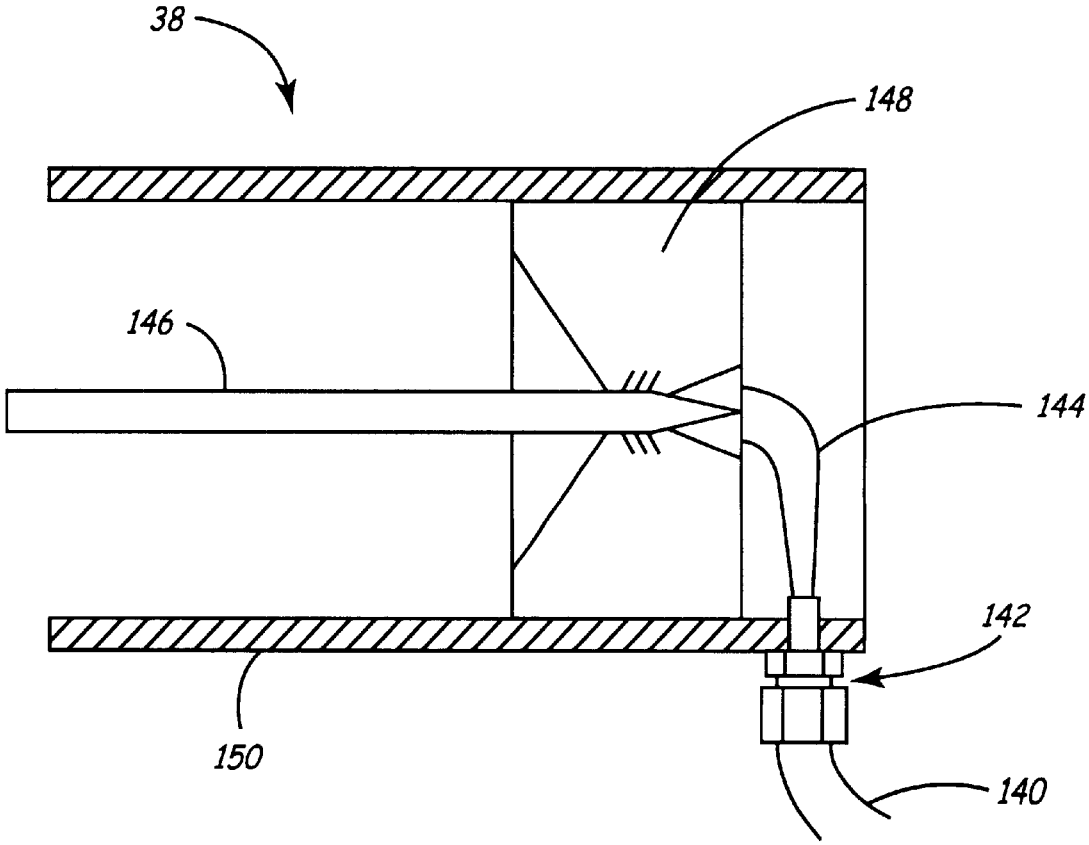
FIG. 5 is a side cross-sectional view of a coupling.

FIG. 5 is a cross-sectional view of coupling 38 which is coupled to, for example, coaxial cabling 140. Cabling 140 connects to a feedthrough 142 which in turn couples to microstrip-line 144. A transmission rod 146 extends through a mounting 148 and into the interior of cylinder 12. The entire assembly is surrounded by feedthrough 150.

Figure 6:
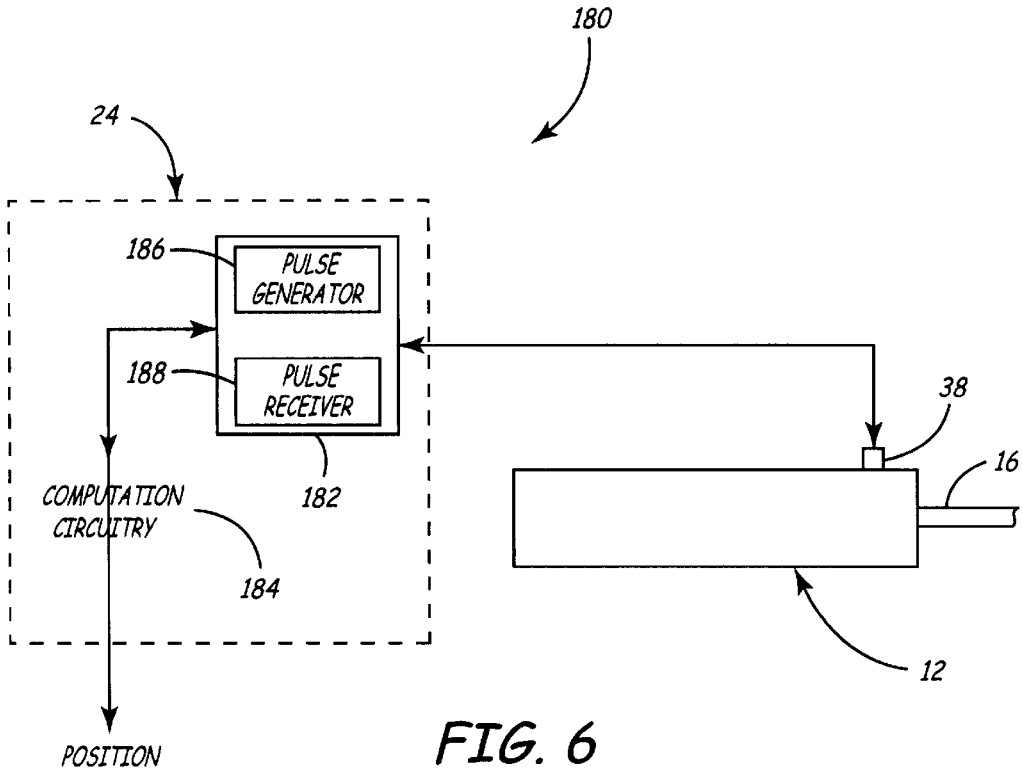
FIG. 6 shows a hydraulic system including a block diagram of position measurement circuitry.

FIG. 6 shows a hydraulic system 180 including a block diagram of position measurement circuitry 24. Position measurement circuitry 24 couples to coupling 38 and includes microwave transceiver 182 and computation circuitry 184. Microwave transceiver circuitry 182 includes a pulse generator 186 and a pulse receiver 188 that operate in accordance with known techniques. Such techniques are described, for example, in U.S. Pat. No. 5,361,070, issued Nov. 1, 1994; U.S. Pat. No. 5,465,094, issued Nov. 7, 1995; and 5,609,059, issued Mar. 11, 1997, all issued to McEwan. As discussed above, computation circuitry 184 measures the position of the piston (not shown in FIG. 6) relative to cylinder 12 based upon the ratio of the time delay between the two return pulses: one from the end of the rod and one from the sliding member which slides along the rod. Based upon this ratio, computation circuitry 184 provides a position output. This can be implemented in a microprocessor or other logic. Additionally, analog circuitry can be configured to provide an output related to position.

The present invention uses a ratio between two reflected signals in order to determine piston position. One reflected signal can be transmitted along the "dipstick" rod from the contact point and another signal can be reflected from the end of the rod. The ratio between the time of propagation of these two signals can be used to determine piston position. Such a technique does not require separate compensation for dielectric variations in the hydraulic oil.

Various aspects of the invention include a piston or cylinder translational measurement device that uses MTDR time of flight techniques. A dual element MTDR transmission line can be provided having a length suitable for measuring the required translation. The dual element transmission line is also desirable because it reduces stray radiation. Preferably, a coupling is provided to couple a transducing element to the dual element transmission line. Some type of contacting body should move along the transmission line and provide an impedance mismatch to cause a reflection in the transmission line. The transducer and/or signal conditioning electronics can be sealed from harsh environmental conditions. An analog, digital or optical link can be provided for communicating the measured displacement to an external device.

A dual transmission line can be fabricated from two separate conducting vias. This can be formed, for example, by two rods with or without insulation. The rods can run substantially in parallel along the length of the transmission line. The rod or rods can be fixed to the cylinder and a contact point coupled to the piston can move along the length of the rod. The contact point can also provide support for the rod or rods. The support can reduce or prevent excessive deflection during high vibration conditions or other stresses. A coupling can be provided to couple to the rod through the cylinder wall.

Various configurations can be used with the present invention. For example, the transducing element, signal generator and signal processing electronics can be mounted in an environmentally protected enclosure on or spaced apart from the cylinder. The dual transmission line can be formed by two conductors embedded in a substantially rigid non-conducting material. The conductors can run substantially parallel to each other along the length of the transmission line. The conductors can be placed in insulation and fabricated in the shape of a single rod. Preferably, the materials are compatible with long term exposure to hydrocarbons such as those present in a hydraulic cylinder.

Diagnostics can be provided to identify the loss or degradation of the contact point or a broken or degrading transmission line. The contact point (sliding member) can be made of a material with a dielectric constant different from the material which forms the transmission line and preferably substantially different. Examples of such materials may include alumina contact and/or glass filled PEEK. Any contact point can be provided such as a roller or a blunt body which slides along the transmission line. The contact point can be urged against the transmission line using any appropriate technique including a spring, magnetic device or fluidic device. However, physical contact is not required as the sliding member can merely be adjacent to the transmission line.

Although a two-conductor sheath rod is described, additional embodiments are practicable wherein the cylinder itself can be considered one conductor and a solid rod can be used therein. In such embodiments, it is important that the cylinder housing itself be maintained at signal-ground. It is generally preferable for dual conductor embodiments, that one of the conductors be held at signal ground.

In the present invention, an absolute measurement is provided and re-zeroing of the system is not required. The system is potentially able to measure piston position with an accuracy of less than plus or minus one millimeter. The maximum measurement length (span) of the system can be adjusted as required and is only limited by power and transmission line geometry. The system is well adapted for harsh environments by using appropriate materials, and providing a good static seal between the transducer and the transmission line. The system requires relatively low power and can be operated, for example, using two wire 4–20 mA systems which are used in the process control such as, for example, HART® and Fieldbus™ communication techniques.

Although the present invention has been described with reference to preferred embodiments, workers skilled in the art will recognize that changes may be made in form and detail without departing from the spirit and scope of the invention.

What is claimed is:

1. An apparatus to measure relative position of a hydraulic piston in a cylinder, comprising:

a rod extending in a direction of movement of the piston fixedly coupled to one of the piston or cylinder, the rod configured to carry a microwave pulse between a coupling and a distal end of the rod;

a sliding member slidably coupled to the other of one of the piston or cylinder, the sliding member configured to cause a partial reflection of the microwave pulse;

microwave transceiver circuitry coupled to the rod configured to generate and receive microwave pulses; and computation circuitry configured to calculate piston position as a function of reflected microwave pulses from the sliding member and the distal rod end.

2. The apparatus of claim 1 wherein the rod comprises two conductors.

3. The apparatus of claim 2 wherein the conductors are substantially parallel.

4. The apparatus of claim 1 wherein the sliding member is fixed to the piston.

5. The apparatus of claim 1 wherein the sliding member is fixed to the cylinder.

6. The apparatus of claim 1 wherein the rod is fixed to the cylinder.

7. The apparatus of claim 1 wherein the rod is fixed to the piston.

8. The apparatus of claim 1 wherein the rod and the sliding member are positioned in the cylinder.

9. The apparatus of claim 1 wherein the rod and sliding member are positioned externally to the cylinder.

10. An apparatus to measure relative position of a hydraulic piston in a cylinder, comprising:

at least one conductor extending in a direction of movement of the piston and fixedly coupled to one of the piston or cylinder, the conductor configured to carry a microwave pulse between a coupling and a distal end of the conductor;

a sliding member slidably coupled to the other of one of the piston or cylinder, the sliding member configured to cause a partial reflection of the microwave pulse;

microwave transceiver circuitry coupled to the conductor configured to generate and receive microwave pulses; and computation circuitry configured to calculate piston position as a function of reflected microwave pulses from the sliding member and the distal conductor end.

11. The apparatus of claim 10 wherein the conductor comprises a rod.

12. The apparatus of claim 10 wherein the conductor comprises two rods.

13. The apparatus of claim 12 wherein the rods are substantially parallel.

14. The apparatus of claim 10 wherein the sliding member is fixed to the piston.

15. The apparatus of claim 10 wherein the sliding contact is fixed to the cylinder.

16. The apparatus of claim 10 wherein the conductor is fixed to the cylinder.

17. The apparatus of claim 10 wherein the conductor is fixed to the piston.

18. The apparatus of claim 10 wherein the conductor and the sliding member are positioned in the cylinder.

19. The apparatus of claim 10 wherein the conductor and sliding member are positioned externally to the cylinder.

20. The apparatus of claim 10 wherein the piston is the conductor.

* * * * *